US010627757B1

(12) United States Patent
Furukawa

(10) Patent No.: US 10,627,757 B1
(45) Date of Patent: Apr. 21, 2020

(54) FIXING DEVICE AND IMAGE FORMING APPARATUS

(71) Applicant: Oki Data Corporation, Tokyo (JP)

(72) Inventor: Takaaki Furukawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/536,739

(22) Filed: Aug. 9, 2019

(30) Foreign Application Priority Data

Sep. 27, 2018 (JP) ..... 2018-181189

(51) Int. Cl.
*G03G 15/20* (2006.01)

(52) U.S. Cl.
CPC . *G03G 15/2057* (2013.01); *G03G 2215/2016* (2013.01)

(58) Field of Classification Search
CPC ..... G03G 15/2053; G03G 15/2057; G03G 2215/2016; G03G 2215/2022
USPC ..... 399/329; 219/216
See application file for complete search history.

(56) References Cited

U.S. PATENT DOCUMENTS

| | | | | |
|---|---|---|---|---|
| 10,082,753 | B2 * | 9/2018 | Goto | G03G 15/2057 |
| 2012/0195654 | A1 * | 8/2012 | Sakakibara | G03G 15/2057 399/333 |
| 2013/0223903 | A1 * | 8/2013 | Matsuura | G03G 15/2053 399/329 |
| 2014/0093290 | A1 * | 4/2014 | Soeda | G03G 15/2039 399/329 |
| 2017/0139359 | A1 | 5/2017 | Goto et al. | |
| 2018/0181038 | A1 * | 6/2018 | Nemoto | G03G 15/2057 |

FOREIGN PATENT DOCUMENTS

JP 2013250393 A 12/2013

* cited by examiner

*Primary Examiner* — Robert B Beatty
(74) *Attorney, Agent, or Firm* — Rabin & Berdo, P.C.

(57) ABSTRACT

A fixing device includes: a belt; a heating element that heats the belt; and a pressure member that faces the belt and forms a nip portion between the pressure member and the belt. A dielectric relaxation rate of the belt 10 seconds after applying a corona discharge at 7000V to the belt is greater than or equal to 9.5% and less than or equal to 28.9%.

13 Claims, 7 Drawing Sheets

FIG. 8

| SAMPLE | CONDUCTIVE FILLER CONTENT (wt%) | DIELECTRIC RELAXATION RATE (%) | DETERMINATION | |
|---|---|---|---|---|
| | | | FIXING BELT | PRESSURE ROLLER |
| 1 | 7.9 | 9.1 | Poor | Good |
| 2 | 8.2 | 9.5 | Fair | Good |
| 3 | 8.5 | 10.1 | Good | Good |
| 4 | 8.5 | 13.4 | Good | Good |
| 5 | 9.1 | 19.6 | Good | Good |
| 6 | 9.4 | 25.1 | Good | Good |
| 7 | 9.4 | 26.9 | Good | Good |
| 8 | 9.4 | 27.4 | Good | Good |
| 9 | 9.5 | 28.9 | Fair | Fair |
| 10 | 9.7 | 31.4 | Poor | Poor |

FIXING DEVICE AND IMAGE FORMING APPARATUS

BACKGROUND OF THE INVENTION

1. Field of the Invention

The present invention relates to a fixing device and an image forming apparatus.

2. Description of the Related Art

A fixing device that fixes developer to a medium includes an endless belt, a heating element that heats the belt, and a pressure member that forms a nip portion between the pressure member and the belt (see, e.g., Japanese Patent Application Publication No. 2013-250393).

The belt moves in contact with members, such as a temperature sensor, and thus is frictionally charged. When charge accumulates on the belt, paper dust or developer can adhere to the belt due to the electrostatic force, thereby causing image unevenness.

SUMMARY OF THE INVENTION

An object of an aspect of the present invention is to reduce accumulation of charge on a belt and reduce adhesion of paper dust or developer to the belt.

According to an aspect of the present invention, there is provided a fixing device including: a belt; a heating element that heats the belt; and a pressure member that faces the belt and forms a nip portion between the pressure member and the belt. A dielectric relaxation rate of the belt 10 seconds after applying a corona discharge at 7000 V to the belt is greater than or equal to 9.5% and less than or equal to 28.9%.

According to another aspect of the present invention, there is provided an image forming apparatus including: an image forming portion that forms a developer image on a medium; and the above fixing device that fixes the developer image to the medium.

BRIEF DESCRIPTION OF THE DRAWINGS

In the attached drawings:

FIG. 8 is a table showing experimental results.

DETAILED DESCRIPTION OF THE INVENTION

An embodiment of the present invention will now be described with reference to the attached drawings.

<Configuration of Image Forming Apparatus>

Figure 1:
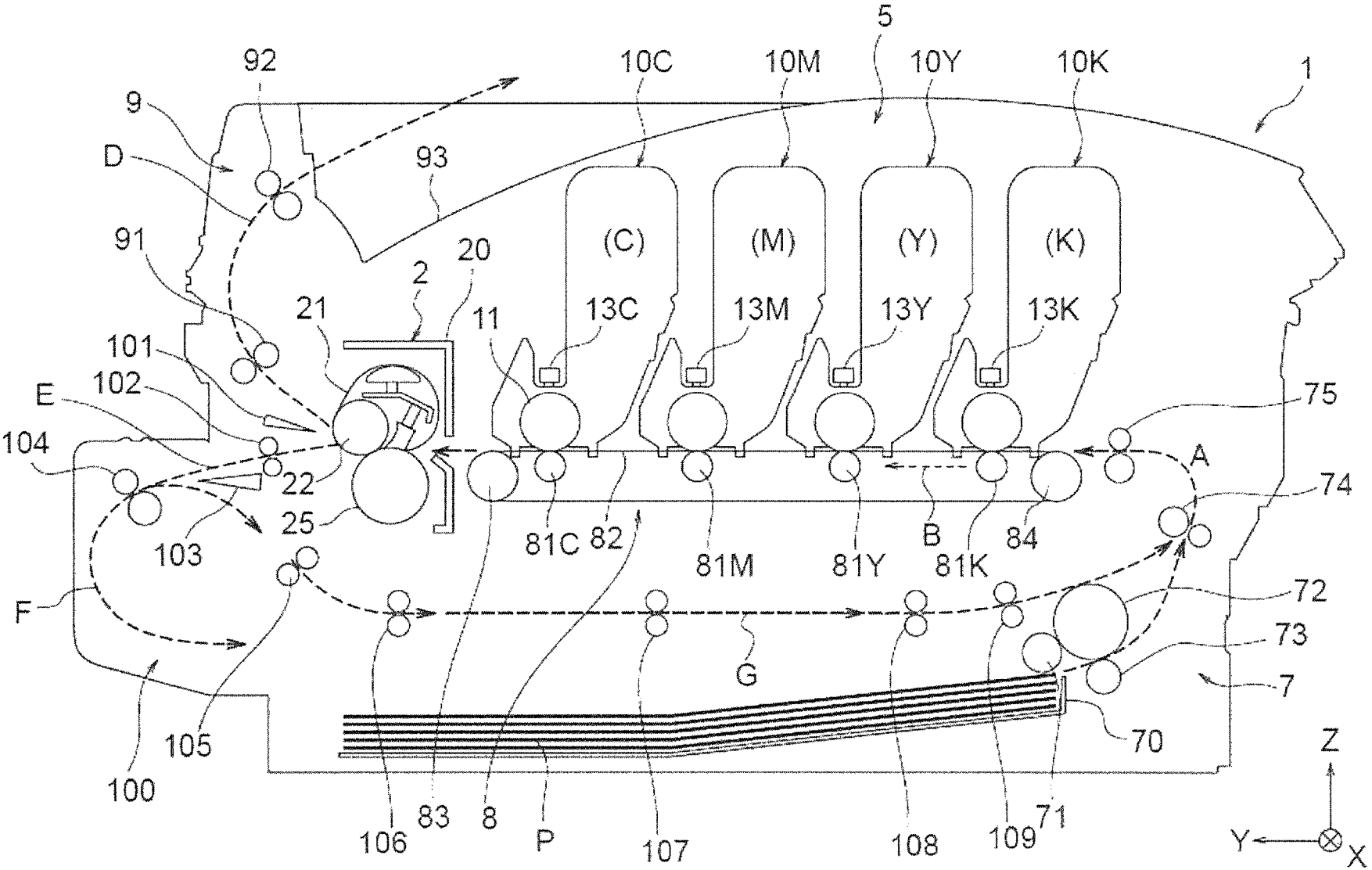
FIG. 1 is a diagram illustrating a configuration of an image forming apparatus of an embodiment.

FIG. 1 is a diagram of an image forming apparatus 1 including a fixing device 2 according to an embodiment of the present invention. The image forming apparatus 1 forms an image on a medium, such as a print sheet, by using electrophotography. The image forming apparatus 1 is a printer in the example illustrated in FIG. 1, but may be a copier, a multifunction peripheral (MFP), or a facsimile machine. Also, the image forming apparatus 1 is a color image forming apparatus for forming a color image in the example illustrated in FIG. 1, but may be a monochrome image forming apparatus for forming a monochrome image.

The image forming apparatus 1 includes a sheet feed mechanism 7 that feeds a medium P, such as a print sheet, an image forming portion 5 that forms a toner image (or developer image) on the fed medium P, the fixing device 2 that fixes the toner image to the medium P, and a sheet discharge mechanism 9 that discharges the medium P.

The sheet feed mechanism 7 includes a sheet feed cassette 70 that stores media P, such as print sheets, in a stacked state, a pickup roller 71 that feeds the media P loaded in the sheet feed cassette 70, a feed roller 72 and a retard roller 73 that separate the fed media P one by one and feeds it to a conveying path A, and pairs of conveying rollers 74 and 75 that convey the medium P fed to the conveying path A to the image forming portion 5.

The image forming portion 5 includes process units 10K, 10Y, 10M, and 10C as image forming units that respectively form black, yellow, magenta, and cyan toner images, and a transfer unit 8 that transfers the toner images formed by the process units 10K, 10Y, 10M, and 10C onto the medium P.

The process units 10K, 10Y, 10M, and 10C are arranged in order along the conveying path of the medium (from right to left in FIG. 1). The process units 10K, 10Y, 10M, and 10C form toner images with black, yellow, magenta, and cyan toners (developers), respectively.

Print heads 13K, 13Y, 13M, and 13C as exposure devices are disposed to face respective photosensitive drums 11 (to be described later) of the process units 10K, 10Y, 10M, and 10C. The process units 10K, 10Y, 10M, and 10C are attached to a main body of the image forming apparatus 1, and the print heads 13K, 13Y, 13M, and 13C are attached to an upper cover of the image forming apparatus 1.

The process units 10K, 10Y, 10M, and 10C have the same configuration except for the toners, and thus may be referred to simply as the process units 10. Also, the print heads 13K, 13Y, 13M, and 13C may be referred to simply as the print heads 13.

Figure 2:
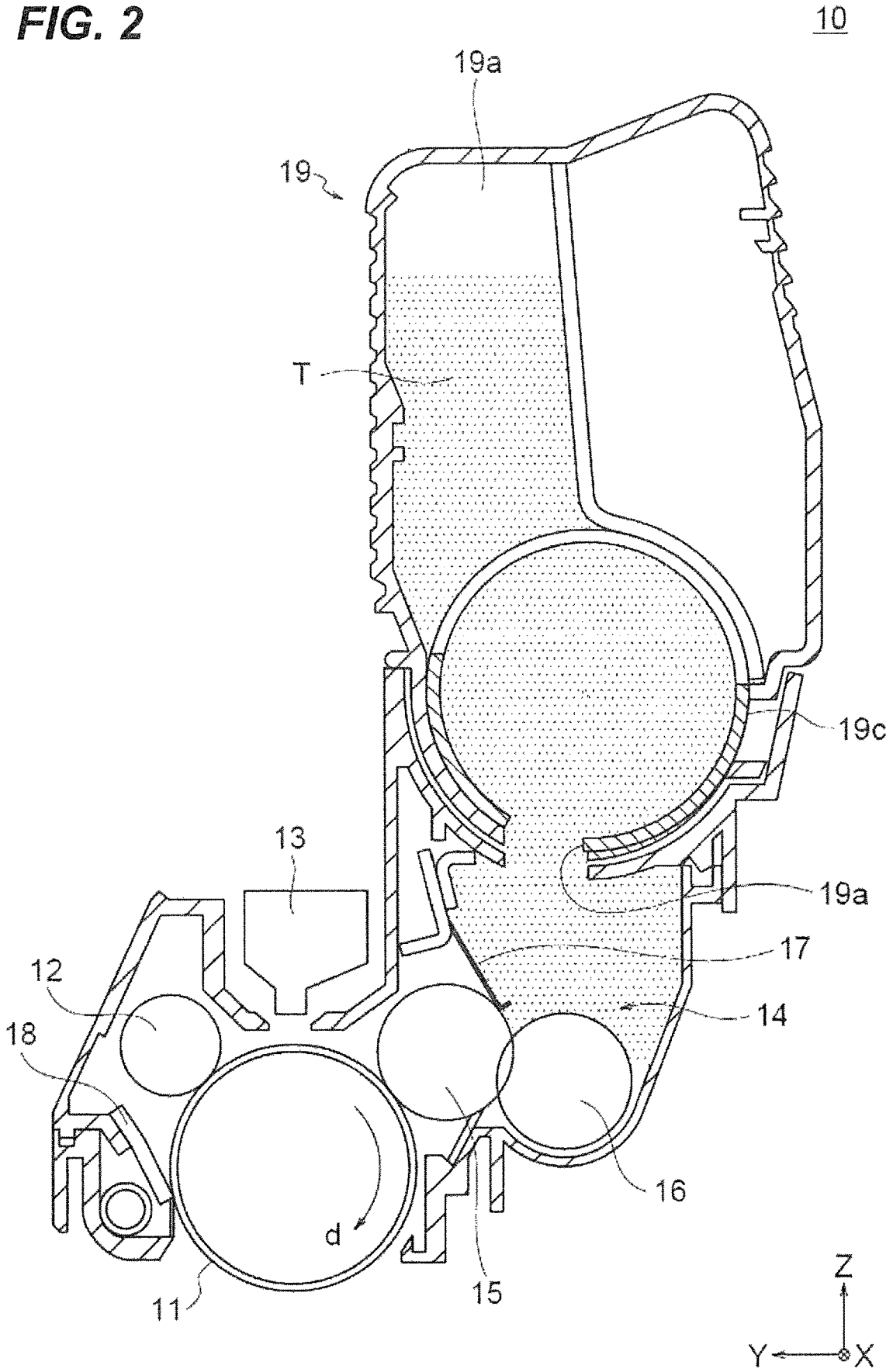
FIG. 2 is a sectional view illustrating a configuration of a process unit of the embodiment.

FIG. 2 is a sectional view illustrating an internal configuration of a process unit 10. The process unit 10 includes the photosensitive drum 11 as an image carrier. The photosensitive drum 11 is a cylindrical member with a photosensitive layer at its periphery and is rotated in one direction (indicated by arrow d) by a corresponding one of drive motors 211K, 211Y, 211M, and 211C (see FIG. 5).

A charging roller 12 as a charging member, the print head 13 as an exposure device, a developing unit 14, and a cleaning member 18 are disposed around the photosensitive drum 11 along the rotational direction of the photosensitive drum 11.

The charging roller 12 is disposed in contact with the photosensitive drum 11, and rotates in accordance with the rotation of the photosensitive drum 11. The charging roller 12 is applied with a charging voltage by a charging voltage controller 202 (see FIG. 5) and uniformly charges a surface of the photosensitive drum 11.

The print head 13 includes, for example, a substrate on which light emitting diodes (LEDs) and a drive circuit are mounted, and a lens array, and is positioned so that light emitted from the LEDs is focused on the surface of the photosensitive drum 11. The print head 13 is driven by an exposure controller 203 (see FIG. 5) and exposes the surface of the photosensitive drum 11 to form an electrostatic latent image.

The developing unit 14 includes a developing roller 15 as a developer carrier disposed to abut the photosensitive drum 11, a supply roller 16 as a supply member disposed to abut or face the developing roller 15, and a developing blade 17 pressed against the developing roller 15.

The developing roller 15 is applied with a developing voltage having the same polarity (e.g., a negative polarity) as the charging polarity of the photosensitive drum 11, by a developing voltage controller 204 (see FIG. 5) and causes toner to adhere to the exposed portion of the photosensitive drum 11, thereby forming a toner image. The supply roller 16 is applied with a supply voltage by a supply voltage controller 205 (see FIG. 5) and supplies toner to the developing roller 15. The developing blade 17 regulates the thickness of a toner layer on a surface of the developing roller 15.

A toner cartridge 19 as a developer container is attached above the developing unit 14. The toner cartridge 19 includes a toner storing portion 19*a* that stores toner (indicated by reference character T), and a shutter 19*c* that opens and closes a toner supply opening 19*b* provided in a bottom portion of the toner storing portion 19*a*. The toner cartridge 19 supplies the toner to the developing unit 14.

The cleaning member 18 is a blade or roller disposed to abut the surface of the photosensitive drum 11, and removes toner (or residual toner) remaining on the surface of the photosensitive drum 11 after transfer.

Returning to FIG. 1, the transfer unit 8 includes a transfer belt 82, a drive roller 83 that drives the transfer belt 82, a tension roller 84 that applies tension to the transfer belt 82, and transfer rollers 81K, 81Y, 81M, and 81C as transfer members.

The transfer belt 82 is stretched around the drive roller 83 and tension roller 84. The drive roller 83 is rotated by a belt drive motor 212 (see FIG. 5) and causes the transfer belt 82 to travel in a predetermined traveling direction (indicated by arrow B in FIG. 1). The transfer belt 82 holds the medium P and conveys it along the process units 10K, 10Y, 10M, and 10C.

The transfer rollers 81K, 81Y, 81M, and 81C are disposed to face the respective photosensitive drums 11 of the process units 10K, 10Y, 10M, and 10C with the transfer belt 82 therebetween. The transfer rollers 81K, 81Y, 81M, and 81C are applied with transfer voltages by a transfer voltage controller 206 (see FIG. 5) and transfer the toner images on the respective photosensitive drums 11 onto the medium P on the transfer belt 82.

The fixing device 2 is disposed downstream of the image forming portion 5 in the conveying direction of the medium P. The fixing device 2 fixes the toner image transferred onto the medium P in the image forming portion 5 to the medium P. The fixing device 2 will be described later.

A switching guide 101 that switches the conveying path of the medium P is disposed downstream of the fixing device 2 in the conveying direction of the medium P. The switching guide 101 guides the medium P conveyed from the fixing device 2 selectively to a discharge conveying path D or to a reconveying path E.

The sheet discharge mechanism 9 includes pairs of discharge rollers 91 and 92 disposed along the discharge conveying path D, and discharge the medium P guided to the discharge conveying path D by the switching guide 101 to the outside of the image forming apparatus 1. A stacking portion 93 on which the medium P discharged by the pairs of discharge rollers 91 and 92 is stacked is provided in the upper cover of the image forming apparatus 1.

For duplex printing, the image forming apparatus 1 also includes a reconveying mechanism 100 that reverses the medium P with the toner image fixed thereto and conveys it to the conveying path A. The reconveying mechanism 100 includes a pair of conveying rollers 102, a switching guide 103, and a pair of conveying rollers 104 that draw the medium P guided to the reconveying path E by the switching guide 101 into a retreat path F and then feed it in the reverse direction.

The reconveying mechanism 100 also includes pairs of conveying rollers 105, 106, 107, 108, and 109 that convey the medium P fed by the pair of conveying rollers 104, to the conveying path A along a return path G. The return path G joins the conveying path A on the upstream side of the pair of conveying rollers 74. The medium P conveyed to the conveying path A through the return path G is conveyed by the pairs of conveying rollers 74 and 75 to the image forming portion 5. When the image forming apparatus 1 has no duplex printing function, the reconveying mechanism 100 can be omitted.

In FIG. 1, a direction in which the medium P moves when passing through the fixing device 2 is taken as a Y direction, a width direction of the medium P passing through the fixing device 2 is taken as an X direction. The X direction is parallel to axial directions of the photosensitive drum 11 and the rollers (i.e., charging roller 12, developing roller 15, and supply roller 16) of each process unit 10. A direction perpendicular to both the X and Y directions is taken as a Z direction.

<Configuration of Fixing Device>

Figure 3:
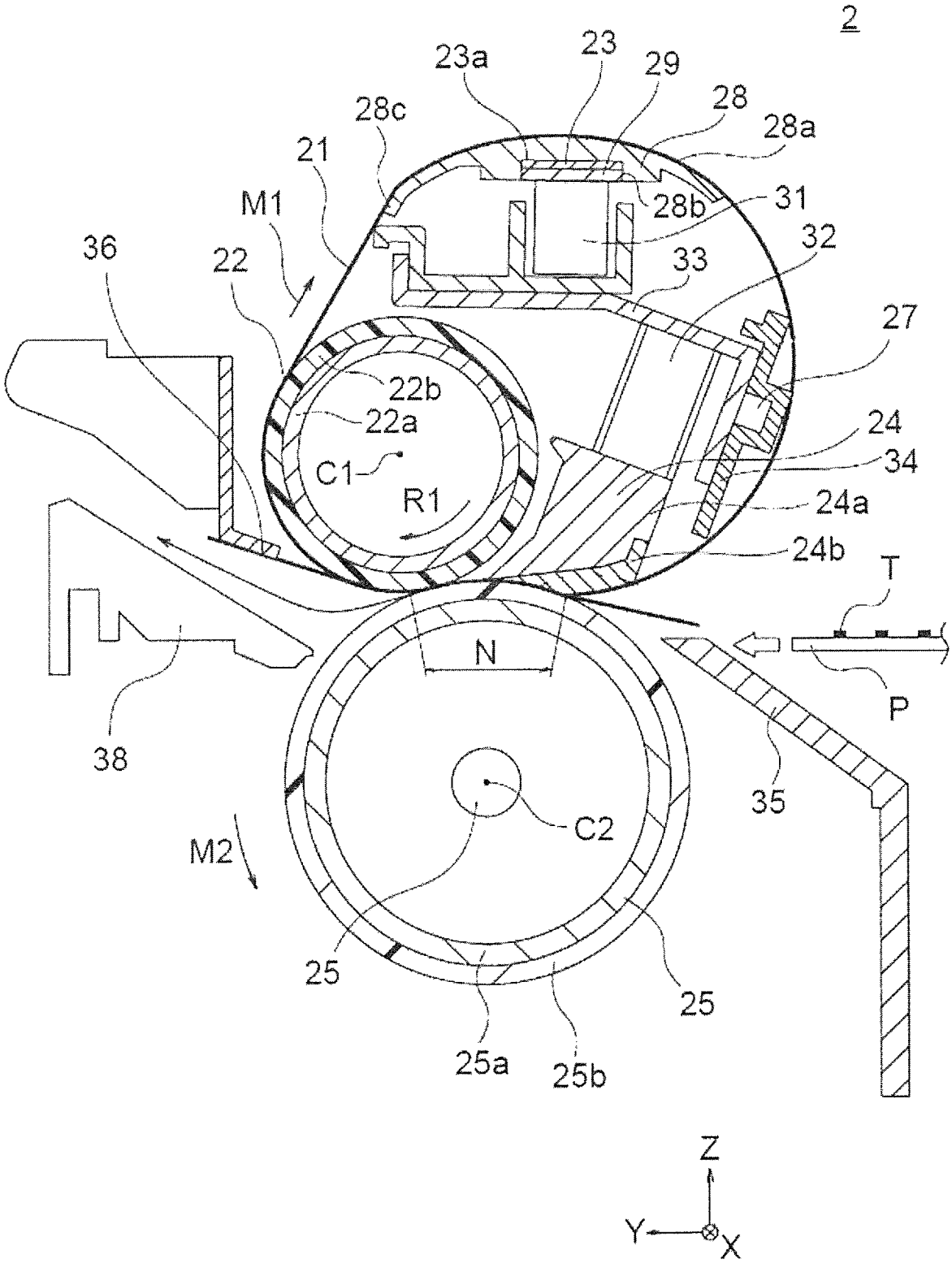
FIG. 3 is a sectional view illustrating a configuration of a fixing device of the embodiment.

FIG. 3 is a diagram illustrating a configuration of the fixing device 2 of the embodiment. As illustrated in FIG. 3, the fixing device 2 includes a fixing belt 21 as a belt, a fixing roller 22 as a fixing member, a heater 23 as a heating element, a heat transfer member 28, a pressure pad 24 as a pressing member, a pressure roller 25 as a pressure member, and a temperature sensor 27.

The fixing belt 21, which is an endless belt, is stretched around the fixing roller 22, the heat transfer member 28, a guide member 34, and the pressure pad 24, and moves in the direction indicated by arrow M1. The fixing belt 21 has a width in a direction perpendicular to both the moving direction indicated by arrow M1 and the thickness direction. The moving direction of the fixing belt 21 indicated by arrow M1 will be referred to as the "belt moving direction."

The heater 23 is a sheet heater including a substrate, heating resistance wire disposed on a surface of the substrate, and a protective layer covering the heating resistance wire. The heater 23 has a heating surface 23*a*. The heater 23 is disposed so that the heating surface 23*a* faces an inner surface of the fixing belt 21.

The heat transfer member 28 is disposed between the heater 23 and the fixing belt 21, and transfers heat from the heater 23 to the fixing belt 21. The heat transfer member 28 has a contact surface 28*a* in contact with the fixing belt 21, and has, opposite the contact surface 28*a*, a recess 28*b* in which the heater 23 is placed. The contact surface 28*a* is a curved surface projecting toward the fixing belt 21. The heat transfer member 28 is supported rotatably about a supporting point 28*c* provided near an end of the heat transfer member 28 in the positive Y direction.

A pressure plate 29 is disposed in the recess 28*b* of the heat transfer member 28 so that the pressure plate 29 abuts a back side of the heater 23. A spring 31 as an urging member is disposed between a support 33 attached to a main body frame 20 (see FIG. 1) of the fixing device 2 and the pressure plate 29. The spring 31 urges the heat transfer member 28 toward the fixing belt 21 through the pressure plate 29. The heat transfer member 28 is pressed against the inner surface of the fixing belt 21 due to the urging by the spring 31.

The fixing roller 22 is disposed inside the fixing belt 21 and is in contact with the inner surface of the fixing belt 21. The fixing roller 22 is a roller whose axial direction extends parallel to the X direction. Specifically, the fixing roller 22 includes a metal core 22*a* and an elastic layer 22*b* disposed on an outer periphery of the metal core 22*a*. The metal core 22*a* is made of, for example, aluminum, and the elastic layer 22*b* is made of, for example, silicone rubber.

Both ends of the metal core 22*a* in the X direction are supported by bearings disposed in the main body frame 20. A drive system is connected to one end of the metal core 22*a* in the X direction and transmits driving force from a fixing drive motor 214 (see FIG. 5) to the end of the metal core 22*a*. Here, the fixing roller 22 rotates in the direction indicated by arrow R1 about a rotational axis C1 extending in the X direction.

The pressure pad 24 is disposed inside the fixing belt 21 and is in contact with the inner surface of the fixing belt 21. The pressure pad 24 is located upstream of the fixing roller 22 in the belt moving direction. The pressure pad 24 is urged toward the pressure roller 25 by a spring 32 as an urging member mounted to the support 33.

The pressure pad 24 includes a main body 24*a* and an elastic body 24*b* disposed on the fixing belt 21 side of the main body 24*a*. The main body 24*a* is made of, for example, metal or resin, and the elastic body 24*b* is made of, for example, silicone rubber. The elastic body 24*b* is pressed against the pressure roller 25 with the fixing belt 21 therebetween.

The pressure roller 25 is disposed to face the fixing roller 22 and pressure pad 24 through the fixing belt 21. The pressure roller 25 is a roller whose axial direction extends parallel to the X direction, and is supported rotatably about a rotational axis C2 extending in the X direction. The pressure roller 25 includes a metal core 25*a* and an elastic layer 25*b* disposed on an outer periphery of the metal core 25*a*. The metal core 25*a* is made of, for example, aluminum, and the elastic layer 25*b* is made of, for example, silicone rubber.

The elastic layer 25*b* of the pressure roller 25 is pressed against the elastic layer 22*b* of the fixing roller 22 and the elastic body 24*b* of the pressure pad 24 through the fixing belt 21, and forms a nip portion N between the elastic layer 25*b* and the fixing belt 21. The pressure roller 25 follows rotation of the fixing roller 22 and rotates in the direction indicated by arrow M2 about the rotational axis C2.

A halogen heater 26 may be disposed inside the pressure roller 25 to facilitate increase in temperature of the surface of the pressure roller 25.

The temperature sensor 27 is disposed inside the fixing belt 21, and is in contact with the inner surface of the fixing belt 21. The temperature sensor 27 is disposed downstream of the heat transfer member 28 and upstream of the pressure pad 24 in the belt moving direction. The temperature sensor 27 is attached to the support 33. The temperature sensor 27 is, for example, a thermistor, and transmits temperature information indicating a temperature of the fixing belt 21 to a fixing controller 209 (see FIG. 5) to be described later.

The guide member 34, which guides the fixing belt 21 from inside the fixing belt 21, is attached to the support 33. The guide member 34 is disposed to surround the temperature sensor 27. The guide member 34 guides the fixing belt 21, within a predetermined section between the heat transfer member 28 and the pressure pad 24 in the belt moving direction.

A conveyance guide 35 is disposed in the negative Y direction from the fixing belt 21 and pressure roller 25 (i.e., upstream of the fixing belt 21 and pressure roller 25 in the conveying direction of the medium P). The conveyance guide 35 guides the medium P from the image forming portion 5 to the nip portion N.

A separating member 36 and a conveyance guide 38 are disposed in the positive Y direction from the fixing belt 21 and pressure roller 25 (i.e., downstream of the fixing belt 21 and pressure roller 25 in the conveying direction of the medium P). The separating member 36 separates the medium P from the fixing belt 21 to prevent the medium P from winding around the fixing belt 21. The conveyance guide 38 guides the medium P to the switching guide 101 (see FIG. 1).

<Configuration of Fixing Belt>

Figure 4:
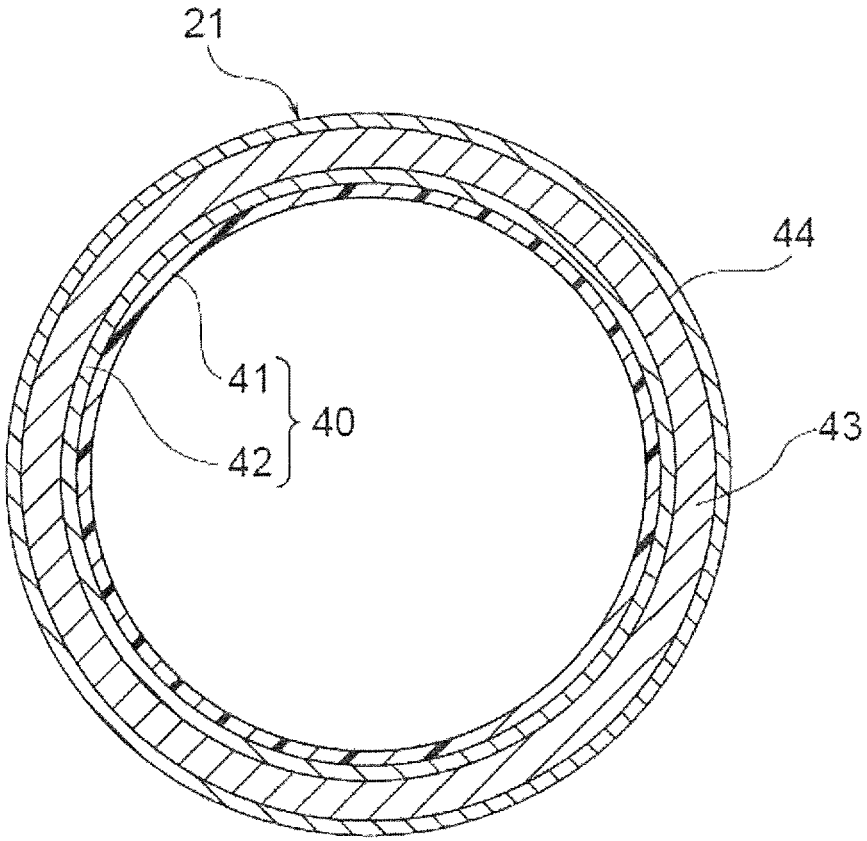
FIG. 4 is a diagram illustrating a sectional structure of a fixing belt of the embodiment.

Next, a configuration of the fixing belt 21 of the embodiment will be described. FIG. 4 is a diagram illustrating a sectional structure of the fixing belt 21. The fixing belt 21 includes a substrate 40, an elastic layer 43, and a surface layer (e.g., release layer) 44, in this order from the inner side. The substrate 40 includes two layers: an insulating layer 41 and a conductive layer 42.

The insulating layer 41 is made of a resin, such as polyimide (PI), polyphenylene sulfide (PPS), or polyether ether ketone (PEEK), that is excellent in heat resistance and strength. The insulating layer 41 preferably has a thickness of, for example, 10 to 100 μm. By setting the thickness of the insulating layer 41 to 10 μm or more, it is possible for the insulating layer 41 to withstand wear due to sliding contact with the members disposed inside the fixing belt 21. By setting the thickness of the insulating layer 41 to 100 μm or less, it is possible to reduce the time required for heat from the heater 23 to be transferred throughout the fixing belt 21.

The conductive layer 42 includes the same resin as the insulating layer 41 and a conductive filler as a conductivity imparting agent (or conductive agent) dispersed in the resin. The conductive filler is preferably, for example, metal, such as Au, Cu, Al, Mg, or Ni, or carbon material, such as graphite, carbon black, carbon nanofibers, or carbon nanotubes. The conductive layer 42 preferably has the same thickness as the insulating layer 41 (e.g., a thickness of 10 to 100 μm).

The conductive layer 42 preferably has a volume resistivity of $10^9$ to $10^{13.5}$ Ω·cm when applied with 100 V. By setting the volume resistivity of the conductive layer 42 to $10^9$ Ω·cm or more, it is possible to prevent dielectric breakdown of the insulating layer 41. By setting the volume resistivity of the conductive layer 42 to $10^{13.5}$ Ω·cm or less, it is possible to reduce charging of the fixing belt 21 due to friction with the above-described members. The volume resistivity is measured by a method according to Japanese Industrial Standards (JIS) K6911.

The elastic layer 43 is made of a material, such as a heat-resistant elastomer (e.g., silicone rubber or fluorine resin), that is excellent in heat resistance and elasticity.

When the elastic layer 43 is made of silicone rubber, the elastic layer 43 preferably has a thickness of 100 to 300 μm.

The surface layer 44 is made of, for example, fluorine resin, such as polytetrafluoroethylene (PTFE), perfluoroalkoxy alkane (PFA), or perfluoroethylene propene copolymer (FEP). The surface layer 44 preferably has a thickness of, for example, 5 to 50 μm.

<Configuration of Control System>

Figure 5:
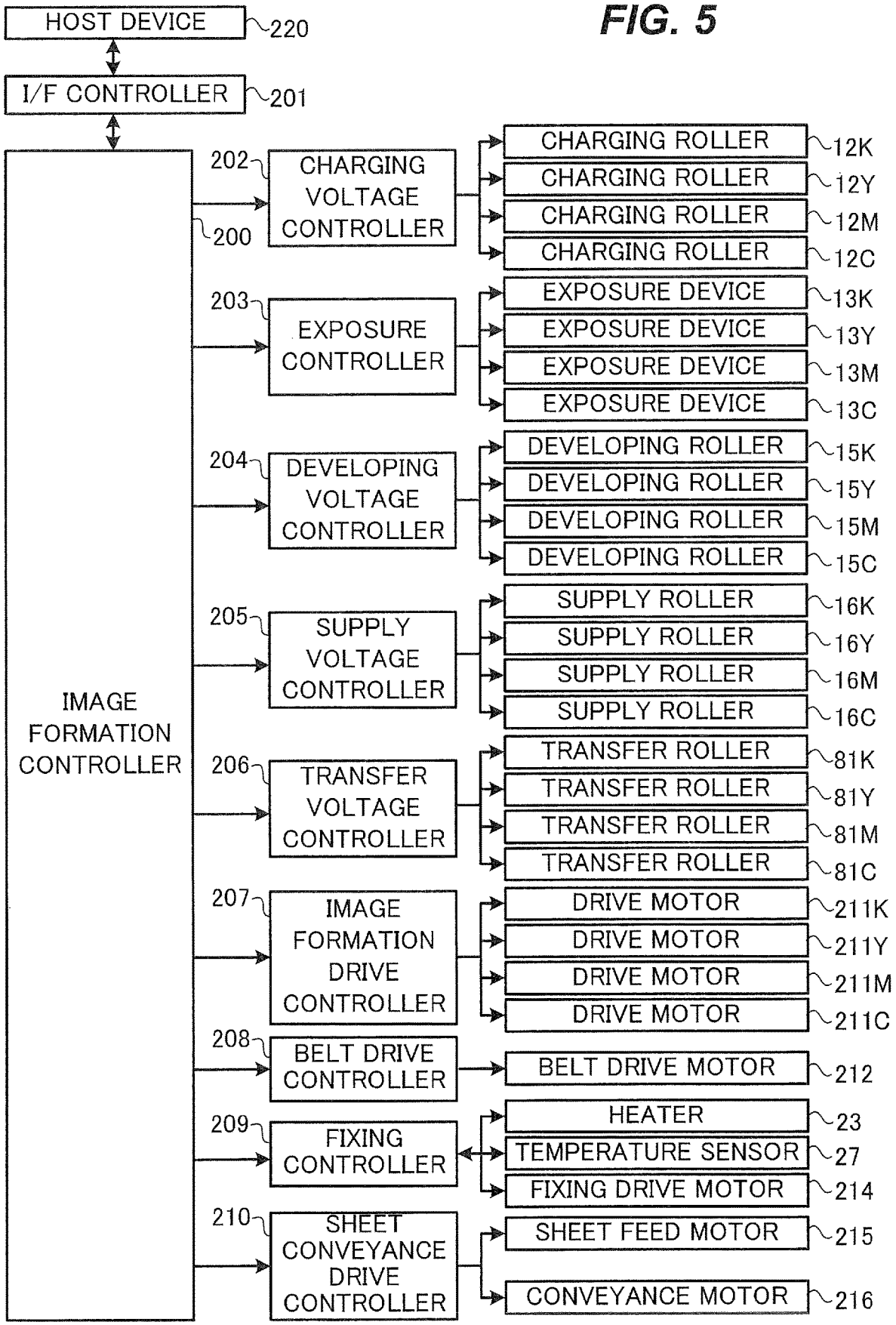
FIG. 5 is a block diagram illustrating a control system of the image forming apparatus of the embodiment.

FIG. 5 is a block diagram illustrating a control system of the image forming apparatus 1. As illustrated in FIG. 5, the image forming apparatus 1 includes an image formation controller 200, an interface (I/F) controller 201, the charging voltage controller 202, the exposure controller 203, the developing voltage controller 204, the supply voltage controller 205, the transfer voltage controller 206, an image formation drive controller 207, a belt drive controller 208, the fixing controller 209, and a sheet conveyance drive controller 210.

The image formation controller 200 controls the entire image forming apparatus 1, and includes a microprocessor, a read only memory (ROM), a random access memory (RAM), an input/output port, and a timer. The image formation controller 200 receives print data and control commands from a host device 220, such as a personal computer, through the I/F controller 201 and performs sequence control of the image forming apparatus 1.

The I/F controller 201 transmits information (such as printer information) of the image forming apparatus 1 to the host device 220. Also, the I/F controller 201 analyzes commands transmitted from the host device 220 and processes data transmitted from the host device 220.

The charging voltage controller 202 controls application of the charging voltages to the respective charging rollers 12 (denoted by 12K, 12Y, 12M, and 12C in FIG. 5) of the process units 10K, 10Y, 10M, and 10C in accordance with commands from the image formation controller 200.

The exposure controller 203 controls driving of the print heads 13K, 13Y, 13M, and 13C according to the print data in accordance with commands from the image formation controller 200.

The developing voltage controller 204 controls application of the developing voltages to the respective developing rollers 15 (denoted by 15K, 15Y, 15M, and 15C in FIG. 5) of the process units 10K, 10Y, 10M, and 10C in accordance with commands from the image formation controller 200.

The supply voltage controller 205 controls application of the supply voltages to the respective supply rollers 16 (denoted by 16K, 16Y, 16M, and 16C in FIG. 5) of the process units 10K, 10Y, 10M, and 10C in accordance with commands from the image formation controller 200.

The transfer voltage controller 206 controls application of the transfer voltages to the transfer rollers 81K, 81Y, 81M, and 81C in accordance with commands from the image formation controller 200.

The image formation drive controller 207 controls driving of the drive motors 211K, 211Y, 211M, and 211C to rotate the respective photosensitive drums 11 of the process units 10K, 10Y, 10M, and 10C in accordance with commands from the image formation controller 200. The charging rollers 12, developing rollers 15, and supply rollers 16 rotate following the photosensitive drums 11.

The belt drive controller 208 drives the belt drive motor 212 to rotate the drive roller 83 in accordance with commands from the image formation controller 200. The transfer belt 82 travels in accordance with rotation of the drive roller 83. Also, the tension roller 84 and transfer rollers 81K, 81Y, 81M, and 81C rotate following the transfer belt 82.

The fixing controller 209 controls (e.g., on/off controls) energization of the heater 23 of the fixing device 2 on the basis of the detected temperature input from the temperature sensor 27. The fixing controller 209 also drives the fixing drive motor 214 to rotate the fixing roller 22 in accordance with commands from the image formation controller 200. The fixing belt 21 and pressure roller 25 rotate following the fixing roller 22. The pairs of discharge rollers 91 and 92 are rotated by rotation transmitted from the fixing drive motor 214.

The sheet conveyance drive controller 210 controls driving of a sheet feed motor 215 and a conveyance motor 216 in accordance with commands from the image formation controller 200. The sheet feed motor 215 rotates the pickup roller 71. The conveyance motor 216 rotates the feed roller 72, pairs of conveying rollers 74 and 75, and pairs of conveying rollers 102 and 104 to 109.

<Operation of Image Forming Apparatus>

The operation of the image forming apparatus 1 will now be described. Upon receiving a print command from the host device 220, the image formation controller 200 of the image forming apparatus 1 rotates the pickup roller 71 to feed a medium P from the sheet feed cassette 70 and conveys the medium P to the image forming portion 5 by means of the feed roller 72 and pairs of conveying rollers 74 and 75.

The image formation controller 200 also rotates the respective photosensitive drums 11 of the process units 10K, 10Y, 10M, and 10C. As the photosensitive drums 11 rotate, the surfaces of the photosensitive drums 11 are charged by the charging rollers 12 and then exposed by the print heads 13 to have electrostatic latent images formed. The electrostatic latent images formed on the surfaces of the photosensitive drums 11 are developed with toner by the developing units 14, so that toner images are formed on the surfaces of the photosensitive drums 11.

The medium P conveyed to the image forming portion 5 is conveyed by the transfer belt 82 and sequentially passes through the process units 10K, 10Y, 10M, and 10C. At this time, the toner images formed on the respective photosensitive drums 11 are transferred onto the medium P on the transfer belt 82 by the transfer rollers 81K, 81Y, 81M, and 81C. Toner remaining on the photosensitive drums 11 after the transfer is removed by the cleaning members 18.

In the fixing device 2, in accordance with commands from the image formation controller 200, the heater 23 is energized to generate heat. Also, the fixing roller 22 is rotated by power transmitted from the belt drive motor 212. The fixing belt 21 and pressure roller 25 also rotate following the rotation of the fixing roller 22. The heat from the heater 23 transfers to the fixing belt 21 through the heat transfer member 28 and heats the fixing belt 21.

The medium P from the transfer belt 82 is conveyed to the nip portion N of the fixing device 2, as illustrated in FIG. 3. When the medium P passes through the nip portion N, the toner image on the medium P is subjected to heat and pressure, and fixed to the medium P.

The medium P to which the toner image has been fixed by the fixing device 2 is guided to the discharge conveying path D by the switching guide 101, discharged by the pairs of discharge rollers 91 and 92 to the outside of the image forming apparatus 1, and placed on the stacking portion 93.

In the case of duplex printing, the medium P is guided to the reconveying path E by the switching guide 101, and conveyed along the return path G by the pairs of conveying rollers 102, switching guide 103, and pairs of conveying rollers 104 to 109 of the reconveying mechanism 100. The medium P is conveyed to the conveying path A through the return path G, and conveyed again by the pairs of conveying rollers 74 and 75 to the image forming portion 5, in which a toner image is formed on the opposite side of the medium P.

<Configuration for Reducing Accumulation of Charge on Fixing Belt>

Next, a configuration for reducing accumulation of charge on the fixing belt 21 in the embodiment will be described. The fixing belt 21 moves in contact with the members (e.g., the temperature sensor 27) disposed inside the fixing belt 21, and thus tends to be frictionally charged. When charge accumulates on the fixing belt 21, paper dust or toner can be attracted by the electrostatic force and adhere to the fixing belt 21.

Figure 6:
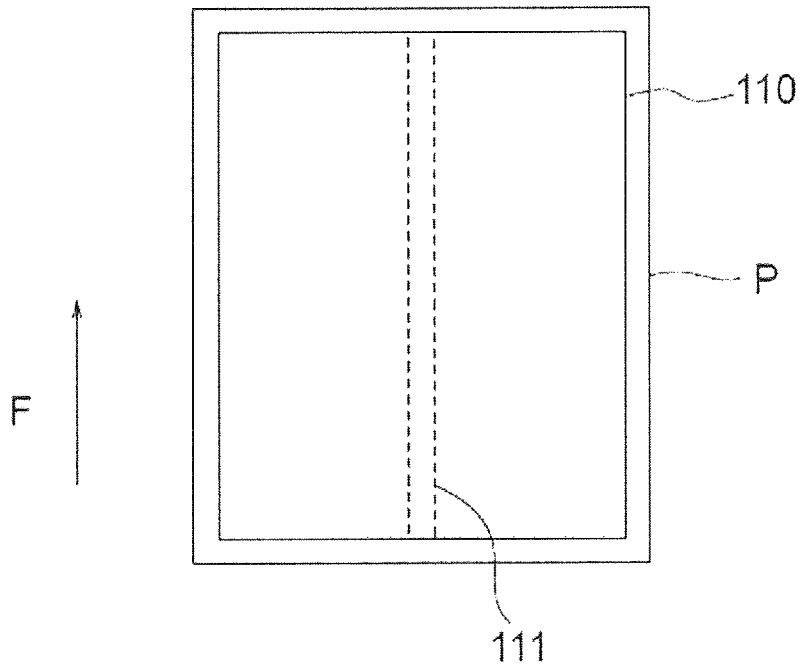
FIG. 6 is a schematic diagram illustrating an example of image unevenness caused by paper dust adhering to the fixing belt.

FIG. 6 is a schematic diagram illustrating an example of image unevenness caused by paper dust adhering to the fixing belt 21. Arrow F indicates the conveying direction of the medium P. Here, it is assumed that the temperature sensor 27 is disposed, for example, at a central portion of the fixing belt 21 in the width direction (i.e., X direction) of the fixing belt 21, but this is not mandatory.

When the fixing belt 21 is charged due to friction with the temperature sensor 27, charge accumulates on a part of the outer surface of the fixing belt 21 corresponding to the temperature sensor 27 and causes paper dust or toner to adhere to the part of the fixing belt 21. This causes a streak 111 at a position corresponding to the temperature sensor 27 (e.g., a center in the width direction) in an image 110 printed on a surface of the medium P. When paper dust adheres to the fixing belt 21, a light streak occurs; when toner adheres to the fixing belt 21, a dark streak occurs. Thus, to reduce accumulation of charge, the present embodiment is configured as follows.

As described above, the substrate 40 of the fixing belt 21 is composed of two layers: the insulating layer 41, and the conductive layer 42 located on the outer side of the insulating layer 41. The insulating layer 41 is made of an insulating resin, and the conductive layer 42 is made of an insulating resin with a conductive filler.

Samples 1 to 10 of the fixing belt 21 were produced. For each sample, the insulating layer 41 was made of polyimide, and the conductive layer 42 was made of polyimide with carbon black as a conductive filler dispersed therein. The content of the conductive filler in the conductive layer 42 was varied among samples 1 to 10.

FIG. 8 shows the content of the conductive filler in each sample. The content of the conductive filler is expressed as a percentage by weight of the conductive filler with respect to the polyimide as a base material. For each sample, the insulating layer 41 was 53 μm in thickness, and the conductive layer 42 was 32 μm in thickness.

For each sample, a corona discharge at 7000 V was applied to the sample, and a dielectric relaxation rate (or charge decay rate) R 10 seconds after the application of the corona discharge was measured. The dielectric relaxation rate R is expressed by the following equation:

$$R=(C0-C10)/C0\times 100(\%),$$

where C0 is a charge amount (i.e., initial charge amount) on the fixing belt 21 at the time of the corona discharge, and C10 is a charge amount on the fixing belt 21 10 seconds after the corona discharge.

Since the charge amount (or surface charge density) is proportional to the surface potential of the fixing belt 21, the dielectric relaxation rate was actually measured as follows.

Figure 7:
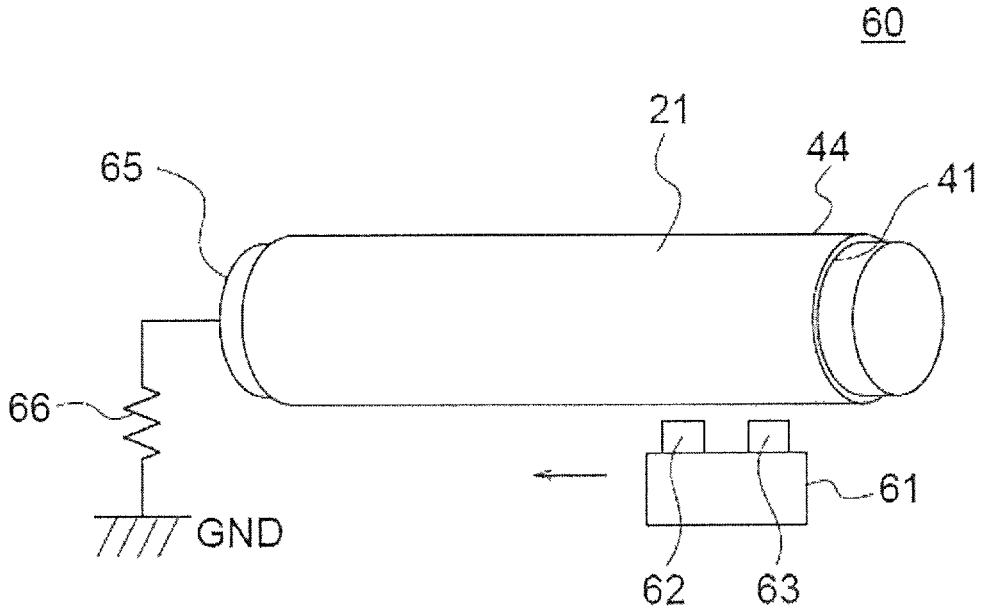
FIG. 7 is a schematic diagram illustrating a method of measuring a dielectric relaxation rate.

FIG. 7 is a schematic diagram illustrating the method of measuring the dielectric relaxation rate of the fixing belt 21. The dielectric relaxation rate was measured by a measurement device 60. As the measurement device 60, a dielectric relaxation analysis system (DRA-2000, manufactured by Quality Engineering Associates) was used.

The measurement device 60 includes a cylindrical conductive support 65 for supporting the fixing belt 21 from inside. The conductive support 65 is grounded through a resistor 66. A carrier 61 with a corona discharge electrode 62 and a probe (electrometer) 63 is disposed to face the surface of the fixing belt 21 mounted to the conductive support 65.

The voltage of the corona discharge by the corona discharge electrode 62 was 7000 V. Specifically, the corona discharge electrode 62 was applied with 7000 V to apply the corona discharge to the fixing belt 21. This voltage corresponds to an actual surface potential of the fixing belt 21 of the fixing device 2 during operation of the image forming apparatus 1. Here, the surface potential (i.e., initial surface potential) V0 of the fixing belt 21 at the time of the corona discharge and the surface potential (referred to below as the residual surface potential) V10 of the fixing belt 21 10 seconds after the corona discharge were measured by the probe 63.

Each of the initial surface potential V0 and the residual surface potential V10 was measured by making measurements while moving the carrier 61 in the axial direction along the surface of the fixing belt 21, and averaging the measurements.

The dielectric relaxation rate R 10 seconds after the application of the corona discharge was obtained by $$R=(V0-V10)/V0\times 100(\%).$$

FIG. 8 shows the measured dielectric relaxation rate R of each of the samples 1 to 10.

Further, for each of the samples 1 to 10, the sample was mounted to the fixing device 2 of the image forming apparatus 1, and a test pattern was printed on media P with black toner by the image forming apparatus 1. As the test pattern, a 2×2 image was used. The 2×2 image is an image obtained by repeatedly printing a 2×2 dot image with a spacing of 2 dots in the horizontal direction and vertical direction.

After printing of the test pattern on the media P, adhesion of paper dust and toner to the surface of the fixing belt 21 was determined by visually observing the surface of the fixing belt 21.

When neither adhesion of paper dust nor adhesion of toner was observed, the fixing belt 21 was determined as "Good". When adhesion of paper dust or toner was observed, the fixing belt 21 was determined as "Poor". However, even when adhesion of paper dust or toner was observed, if its amount is slight and insufficient to affect printed images, the fixing belt 21 was determined as "Fair".

Also, adhesion of paper dust and toner to the surface of the pressure roller 25 was determined by visually observing the surface of the pressure roller 25, in the same manner as the fixing belt 21.

FIG. 8 shows, for each sample, the content of the conductive filler, the dielectric relaxation rate, the result of the determination of the surface of the fixing belt 21, and the result of the determination of the surface of the pressure roller 25.

As shown in FIG. 8, for sample 1, whose dielectric relaxation rate 10 seconds after the application of the corona discharge at 7000 V was 9.1%, adhesion of paper dust or toner was observed on the surface of the fixing belt 21. For sample 2, whose dielectric relaxation rate was 9.5%, adhesion of paper dust or toner insufficient to affect printed images was observed on the surface of the fixing belt 21.

For sample 10, whose dielectric relaxation rate 10 seconds after the application of the corona discharge at 7000 V was 31.4%, adhesion of paper dust or toner was observed on both the surface of the fixing belt 21 and the surface of the pressure roller 25. For sample 9, whose dielectric relaxation rate was 28.9%, adhesion of paper dust or toner insufficient to affect printed images was observed on both the surface of the fixing belt 21 and the surface of the pressure roller 25.

This is thought to be because, when the dielectric relaxation rate is too small, a large amount of charge remains on the fixing belt 21, causing charged paper dust or toner to adhere to the fixing belt 21, and on the other hand, when the dielectric relaxation rate is too large, charge transfers from the fixing belt 21 to the pressure roller 25, causing charged paper dust or toner to adhere to the pressure roller 25.

The above results show that when the dielectric relaxation rate 10 seconds after the application of the corona discharge at 7000 V is within the range of 9.5 to 28.9%, no adhesion of paper dust and toner sufficient to affect printed images occurs on the surfaces of the fixing belt 21 and pressure roller 25, so that good images are produced.

The above results also show that when the dielectric relaxation rate 10 seconds after the application of the corona discharge at 7000 V is within the range of 10.1 to 27.4%, adhesion of paper dust and toner to the surfaces of the fixing belt 21 and pressure roller 25 is further reduced, so that better images are produced.

From the above results, by setting the dielectric relaxation rate 10 seconds after applying a corona discharge at 7000 V to the fixing belt 21 within the range of 9.5 to 28.9% (more preferably 10.1 to 27.4%), it is possible to reduce adhesion of paper dust and toner to the fixing belt 21 and pressure roller 25, thereby producing high-quality images.

Advantages of Embodiment

As described above, the fixing device 2 of the embodiment includes the fixing belt 21 as a belt, the heater 23 as a heating element that heats the fixing belt 21, and the pressure roller 25 as a pressure member that forms a nip portion between the pressure roller 25 and the fixing belt 21, the dielectric relaxation rate of the fixing belt 21 measured 10 seconds after applying a corona discharge at 7000 V to the fixing belt 21 being greater than or equal to 9.5% and less than or equal to 28.9%. With this configuration, it is possible to reduce accumulation of charge on the fixing belt 21. As a result, it is possible to reduce adhesion of paper dust and toner, thereby producing high-quality images.

By setting the dielectric relaxation rate measured 10 seconds after applying a corona discharge at 7000 V to the fixing belt 21 to be greater than or equal to 10.1% and less than or equal to 27.4%, it is possible to enhance the effect of reducing adhesion of paper dust and toner, thereby producing higher-quality images.

The fixing belt 21 includes the insulating layer 41 located on the innermost side of the fixing belt 21, the conductive layer 42 formed on the surface of the insulating layer 41, the elastic layer 43 formed on the surface of the conductive layer 42, and the surface layer 44 formed on the surface of the elastic layer 43. Thus, by changing the content of the conductive filler (or conductivity imparting agent) in the conductive layer 42, it is possible to control the ease of escape of charge.

The fixing device 2 includes, inside the fixing belt 21, the fixing roller 22 disposed so that the fixing belt 21 is sandwiched between the fixing roller 22 and the pressure roller 25. Thereby, it is possible to form a stable nip portion between the fixing roller 22 and the pressure roller 25.

The fixing device 2 includes, inside the fixing belt 21, the pressure pad 24 disposed adjacent to the fixing roller 22 in the moving direction of the fixing belt 21. Thereby, it is possible to form the wide nip portion N between the fixing roller 22 and the pressure roller 25 and between the pressure pad 24 and the pressure roller 25. This can improve fixation of the toner image and also allows the printing speed to be increased.

The fixing device 2 includes the temperature sensor 27 disposed in contact with the inner surface of the fixing belt 21. Thereby, the temperature of the fixing belt 21 can be detected accurately.

The present invention is not limited to the embodiment described above; it can be practiced in various other aspects without departing from the scope of the invention.

For example, although the pressure pad 24 is provided in the above embodiment, the pressure pad 24 may be omitted. Also, although in the above embodiment, the heat transfer member 28 makes contact with the fixing belt 21 from inside the fixing belt 21, the heat transfer member 28 may make contact with the fixing belt 21 from outside the fixing belt 21.

Although in the above embodiment, the pressure roller 25 is provided to form the nip portion N, a non-roller shaped sliding member may be provided instead of the pressure roller 25. Also, although in the above embodiment, the fixing roller 22 is used as a drive source, the pressure roller 25 may be used as a drive source.

What is claimed is:

1. A fixing device comprising:
- a belt including:
  - a substrate;
  - an elastic layer formed on a surface of the substrate; and
  - a surface layer formed on a surface of the elastic layer;
- a heating element that heats the belt; and
- a pressure member that faces the belt and forms a nip portion between the pressure member and the belt,
- wherein a dielectric relaxation rate of the belt 10 seconds after applying a corona discharge at 7000 V to the belt is greater than or equal to 9.5% and less than or equal to 28.9%.

2. The fixing device of claim 1, wherein the dielectric relaxation rate of the belt 10 seconds after applying a corona discharge at 7000 V to the belt is greater than or equal to 10.1% and less than or equal to 27.4%.

3. The fixing device of claim 1, wherein the substrate includes:
- an insulating layer located on an innermost side of the belt; and
- a conductive layer formed on a surface of the insulating layer, and
- wherein the elastic layer is formed on a surface of the conductive layer.

4. The fixing device of claim 3, wherein the insulating layer comprises polyimide, polyphenylene sulfide, or polyether ether ketone.

5. The fixing device of claim 3, wherein the conductive layer comprises a resin and a conductivity imparting agent dispersed in the resin.

6. The fixing device of claim 5, wherein the conductivity imparting agent is metal or carbon material.

7. The fixing device of claim 3, wherein the elastic layer comprises silicone rubber or fluorine resin.

8. The fixing device of claim 3, wherein the surface layer comprises fluorine resin.

9. The fixing device of claim 1, further comprising, inside the belt, a fixing member disposed so that the belt is sandwiched between the fixing member and the pressure member.

10. The fixing device of claim 9, further comprising, inside the belt, a pressing member disposed adjacent to the fixing member in a moving direction of the belt so that the belt is sandwiched between the pressing member and the pressure member.

11. The fixing device of claim 1, wherein the heating element is disposed inside the belt.

12. The fixing device of claim 1, further comprising a temperature sensor disposed in contact with an inner surface of the belt.

13. An image forming apparatus comprising:

an image forming portion that forms a developer image on a medium; and the fixing device of claim 1 that fixes the developer image to the medium.

* * * * *